United States Patent [19]

Korshak

[11] 4,096,966

[45] Jun. 27, 1978

[54] SELF-RIGHTING CUPS

[76] Inventor: Marvin Stanley Korshak, 1738 Montemar Way, San Jose, Calif. 95125

[21] Appl. No.: 688,141

[22] Filed: May 20, 1976

Related U.S. Application Data

[63] Continuation-in-part of Ser. No. 598,235, Jul. 23, 1975, abandoned.

[51] Int. Cl.[2] ..... B65D 11/00

[52] U.S. Cl. ..... 220/69; 220/76; 46/155

[58] Field of Search ..... 220/69, 70, 90.4, 76; 46/155

[56] References Cited

U.S. PATENT DOCUMENTS

| | | | |
|---|---|---|---|
| 2,601,767 | 7/1952 | Wall | 220/69 |
| 2,767,563 | 10/1956 | Picascia | 220/69 |
| 2,937,872 | 5/1960 | Gilman | 46/155 |
| 3,323,798 | 6/1967 | Miller | 46/155 |
| 3,699,913 | 10/1972 | Sautbine | 46/155 |

*Primary Examiner*—William Price
*Assistant Examiner*—Joseph M. Moy

[57] ABSTRACT

The present invention is concerned with self-righting drinking cups and provides for a two part cup, the first part of which is a generally hollow cylindrical liquid container, and the second part of which is a base for the liquid container. The base member has a convex surface progressively decreasing from its junction with the drinking cup proper to the lowermost portion of the base.

Certain dimensional ratios are critical to the self-righting performance of the cup. The diameter of the lowermost portion of the base must be about 0.39 to 0.75, preferably 0.39 to 0.65, and most preferably 0.40 to 0.60 of the greatest diameter of the drinking cup itself.

Further, the critical ratio of cup height to maximum cup diameter must be about 0.80 to 1.1, preferably about 1.02 (about 1).

Further, the critical ratio of cup height to the diameter of the lowermost portion of the base must be about 1.3 to 2.5, preferably 1.3 to 2.2, and more preferably about 2.13.

Further, the critical ratio of cup height to height of convex portion of base member must be about 1.8 to 3.2, preferably about 2.

Cups which are constructed within the foregoing critical parameters have outstanding self-righting characteristics.

5 Claims, 7 Drawing Figures

SELF-RIGHTING CUPS

RELATED APPLICATION

This application is a continuation-in-part of parent application Ser. No. 598,235, filed July 23, 1975 now abandoned.

INTRODUCTION

This invention relates to self-righting drinking cups having a novel construction involving critical ratios of cup base diameter, cup height, maximum cup diameter and height of curved portion.

PRIOR ART

Some forms of self-righting drinking cups are known. One such drinking cup comprises a cylindrical wall portion upstanding from a base having a generally hemispherical outer shape. Located centrally at the foot of the base is a flat cup-supporting region on which the drinking cup rests when upright. In the said one such drinking cup the flat region is only of small diameter (about ⅜ inch) when compared with the diameter (about 2½ inch) of the generally hemispherical base. Ballast in the form of a special cast lead weight, iron, lead or scrap metal weight is provided in a cavity formed in the base.

As is well known the reason for providing the generally hemispherical base is that, on tilting a cup having a sufficiently low center of gravity, the instantaneous pivot point of the base will be moved further than and in the same direction as the center of gravity of the drinking cup, thereby permitting the drinking cup to be tilted to a further extent without toppling over completely than would be the case if such a region of generally hemispherical outer shape were absent, and permitting the drinking cup to roll back into an upright position.

A disadvantage of the drinking cup described above is that as the flat cup-supporting region at the foot of the base is of relatively small diameter compared with the breadth (and height) of the drinking cup. Consequently the drinking cup is very unstable and may easily be tilted from its fully upright position. Thus, relatively heavy ballast (for example 3 oz.) is required to provide only inadequate stability for a small drinking cup and in the lightest available form the total weight of the drinking cup is 4.5 oz., and such ballast is usually provided in the form of an expensive cast iron weight. Consequently, the drinking cup may be too heavy for a small baby (e.g. one of between 5 months and 1 year of age) to use and this is the age when a baby usually learns to drink from a drinking cup. Moreover, the parents themselves often find the drinking cup weight to be excessive and inconvenient. The substantial weight not only adds to manufacturing costs but also adds substantially to the cost of transporting the drinking cups. Further, even with such heavy ballast, on righting itself, the drinking cup tends to rock back and forth several times before coming to rest in its fully upright position often resulting in spilling of the contents of the drinking cup.

I am also familiar with a modified self-righting cup having a very small round shaped flat surface of 22 mm in diameter, otherwise similar to the drinking cup shown in the drawings of the Wall U.S. Pat. No. 2,601,767.

I have had considerable practical experience with the drinking cups described and shown in the drawings in my above identified U.S. patent application.

There is a serious drawback with the design of the Wall U.S. Pat. No. 2,601,767, and even of a modified cup having a small round shaped flat surface of 22 mm in diameter in the bottom thereof. In both cases, cups of the type shown in the Wall patent have been found to spill over easily with the slightest sidewise directed touch of just a finger, and such a cup then starts a long period of wobble in an attempt to right itself. Indeed, the period of wobble is practically endless, and continues for at least up to 25 times before the cup finally comes to a complete upright position of rest. Thus, the entire design is of no real practical value. Whereas the user is initially caused to believe that such a device will reduce or eliminate spilling, he actually finds that the device proves to spill even more than just a regular flat bottom unweighted cup.

OBJECTS OF THE INVENTION

It is an object of the invention to obviate, or at least reduce, the effect of some or all of the above mentioned disadvantages.

DETAILED DESCRIPTION OF THE INVENTION

According to this invention there is provided a self righting drinking cup comprising a generally cylindrical hollow member having a side wall and a bottom wall for the reception of a liquid, a ballasted circular base member on which the hollow member is mounted, which base member has a convex surface progressively decreasing from the junction of said base member and said hollow member, to the lowermost portion of said base member.

Certain dimensional ratios are critical to the self-righting performance of the cup. The diameter of the lowermost portion of the base must be about 0.39 to 0.75, preferably 0.39 to 0.65, and most preferably 0.40 to 0.60 of the greatest diameter of the drinking cup itself.

Further, the critical ratio of cup height to maximum cup diameter must be about 0.80 to 1.1, preferably about 1.02 (about 1).

Further, the critical ratio of cup height to the diameter of the lowermost portion of the base must be about 1.3 to 2.5, preferably 1.3 to 2.2, and more preferably about 2.13.

Further, the critical ratio of cup height to height of convex portion of base member must be about 1.8 to 3.2, preferably about 2.

Cups which are constructed within the foregoing critical parameters have outstanding self-righting characteristics.

The feature that the plane defined by the lowermost portion of the base member has a diameter of about 0.39–0.75 of the maximum diameter of the hollow member of the crinking cup is inherently more stable than previously known drinking cups and is unlikely to oscillate (i.e. rock or wobble) back and forth for a long time when righting itself. It will be apparent, therefore, that less ballast is required to stabilize the drinking cup of the invention than the previously known drinking cup. The drinking cup is thus lighter and more convenient to use than the self-righting drinking cups known previously, and additionally is less expensive to manufacture and transport.

In a preferred embodiment of the invention, a compartment is provided in the base member of the drinking cup, the compartment being provided with, or being intended to receive ballast centrally located within the base.

Advantageously, the drinking cup comprises a generally cylindrical hollow member having a side wall and a bottom wall, and a base member, the hollow member being provided with a peripheral flange on the undersurface thereof and the base member being engageable with said flange to form said compartment. For example, the base member may be provided with a peripheral flange adapted to engage the peripheral flange of the hollow member, the peripheral flange of the base member being adapted to form a push or screw fit with the peripheral flange of the hollow member.

This provides the advantage that the base member may be removed if not required and the drinking cup used without any base member or ballast. Thus, with this ballast removal facility, the drinking cup or beaker may then function as a conventional drinking cup or beaker. Alternatively, the base member may be permanently attached to the base of the hollow member by using a suitable adhesive or bonding agent or an ultrasonic or spin welding or other appropriate welding technique. If desired the ballast may be carried on the underside surface of the hollow member.

Conveniently, the side wall defining said generally cylindrical hollow member tapers progressively inwardly in its upper region as it extends towards said base member, providing the advantage that the drinking cup may be nested together for storage.

Advantageously, the drinking cup may be formed by injection molding technique, from a suitable plastics material such as polypropylene which is light in weight, durable, and may be boiled in water for sterilization without being damaged.

The drinking cup may be without handles, although when required, such drinking cup may be provided with one or more handles and, in a preferred embodiment, two handles are provided respectively on the exterior surfaces of diametrically opposed sides of the drinking cup side wall.

Any suitable inexpensive ballast may be used, for example, a metal washer, metal scrap, sand or the like and may for example, be located centrally in the compartment provided or formed integrally with the base member of the drinking cup by a molding technique, during the formation of the drinking cup itself.

Conveniently, the metal ballast may be in the form of a single metal member which is retained in position in said compartment by means of a foamed plastics material.

Expediently the drinking cup may be provided with a scale on the side wall defining said generally cylindrical hollow member so that the drinking cup may be utilized as a measuring cup, both with and without the base member attached, and said scale may be embossed on the side wall.

The drinking cup may also be provided with a lid adapted to be secured to the open end of said generally cylindrical hollow member. The lid may have two apertures therein, and may be molded from high density polyethylene or polypropylene.

DRAWINGS

FIG. 1 is a top perspective view of a drinking cup in accordance with the invention;

FIG., 2 is a side elevation of the drinking cup shown in FIG. 1;

Figure 1:
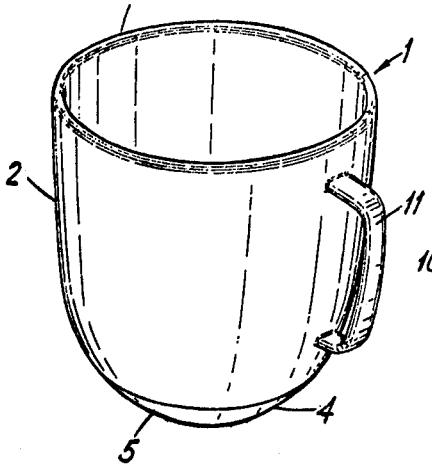
Figure 2:
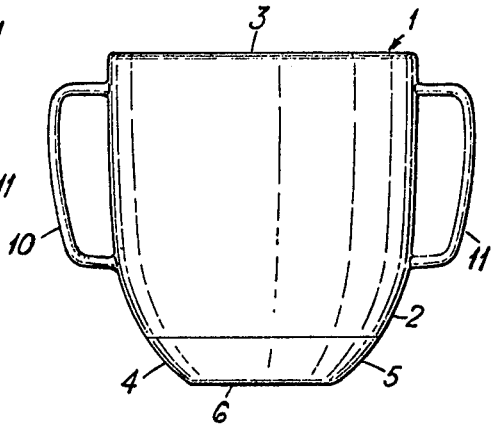
Figure 3:
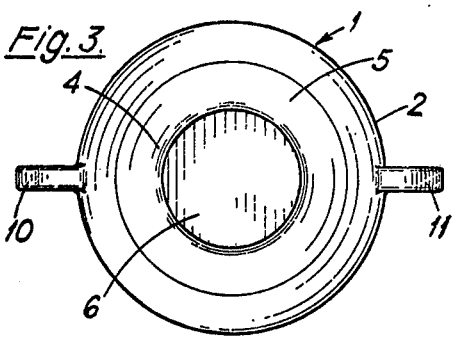
FIG. 3 is an underneath view of the drinking cup shown in FIG. 1.
Figure 4:
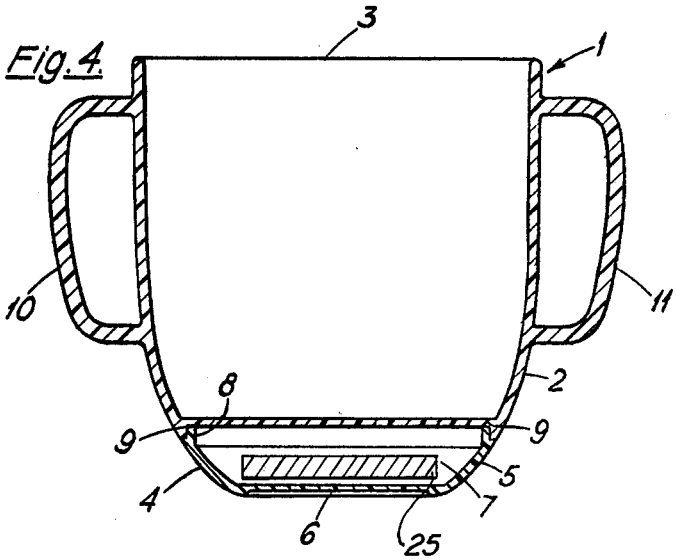
FIG. 4 is a cross sectional view of the drinking cup shown in FIG. 1.

In the embodiment shown, the drinking cup comprises a generally cylindrical hollow member 1 having a side wall 2 and a bottom wall. At the open end or mouth 3 of the hollow member 1, a bead may be formed on the side wall which extends around the periphery to form a lip. A base member 4 is provided, and the side wall 2 curves progressively inwardly as it extends towards the base member 4. The side wall 2 tapers slightly inwardly for a distance of about five-eighths of the height of the hollow member 1 drinking cup and then curves progressively inwardly (i.e. is radiussed) to join the base member 4. The base member 4 also has a curved wall 5 which, in conjunction with the side wall 2 provides a convex outer surface for the drinking cup. The base member 4 also has a drinking cup supporting portion 6, at its lowermost part which is a flat, substantially circular portion which has a diameter which is about 0.39 to 0.75 of the diameter of the cup, preferably 0.39 to 0.65 and more preferably 0.40 to 0.60. Between the lowermost part 6 of the base member and the junction of the base member with side wall of the drinking cup there is provided a convex surface of gradually increasing diameter. There is a critical ratio of cup height to height of this convex (curved) portion, which is 1.8–3.2. One specific instance of great advantage is about 2.0, or 2.025.

The base member is formed as a separate member forming a compartment 7 in which ballast may be located. An upstanding flange 8 is formed around the periphery of the base member 4. A downwardly depending flange 9 is formed on the periphery of the hollow member 1 so that the flange 8 can engage therein and be bonded thereto (e.g. by adhesive or by using an ultrasonic or spin welding technique) to locate the base member 4 on the hollow member 1.

The ballast, which may be an inexpensive metal washer or a piece of scrap metal 25, lies in the compartment formed by the base member 4 so that its center of gravity lies on a vertical axis passing through the center of gravity of the drinking cup. The metal washer or piece of scrap metal may be retained in position by an insert of a foamed plastics or other packing material (not shown) provided between an upper face of the ballast and the lower face of the bottom wall of the hollow member 1.

The side wall 2 of the hollow member 1 is generally of uniform thickness, and two handles 10, 11 are provided, located on diametrically opposed sides of the drinking cup side wall.

The hollow member 1 and the base member 4 are formed from a plastics material such as polypropylene by an injection molding process. If polypropylene is used, the drinking cup may be boiled without being damaged. Of course, other plastics materials may be used such as ABS.

Figure 6:
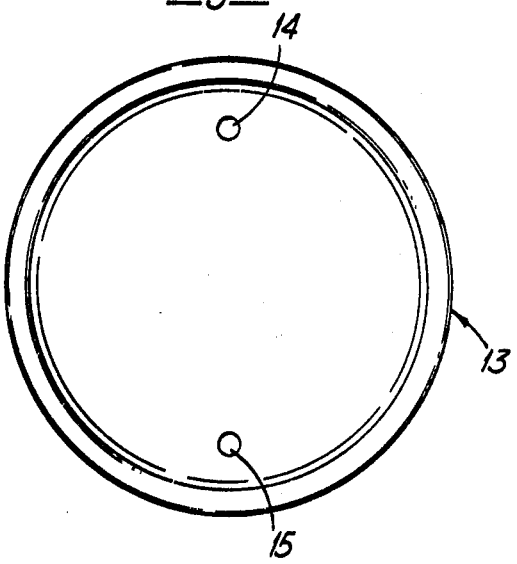
FIG. 6 is a plan view of a lid to fit the drinking cup shown in FIG. 1.
Figure 7:
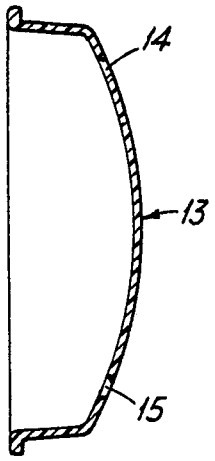
FIG. 7 is a cross sectional view of the lid shown in FIG. 6.

The hollow member 1 may be provided with a circular lid 13, shown in FIGS. 6 and 7. The lid 13 is made of high density polyethylene or polypropylene and has a dome shaped portion that has two apertures 14, 15 therein on one diameter thereof. The lid has an upwardly extending flange which is adapted to engage with the interior of the side wall 2 of the hollow member 1, so that the lid 13 will be a press fit in the mouth of the hollow member, so that the domed portion of the lid is received within the hollow member 1. When the lid is in position on the drinking cup liquid may only leave the drinking cup through the apertures 14 and 15, and thus the possibility of any spillage is minimized. The lid may also be boiled in water without being damaged.

In one embodiment the external diameter of the drinking cup, at its maximum, is about 79.5 mm, the overall external height of the cup is about 81 mm, the internal depth of the drinking cup is about 66 mm, the height of the convex portion 2 plus 5 is 40 mm, and the diameter of the lowermost part of the base member 6 is about 38 mm.

Accordingly, the ratio of the cup base diameter to the maximum cup diameter is 38 divided by 79.5, or 0.478. The ratio of cup height to maximum cup diameter is 81 divided by 79.5 or 1.02. Further, the ratio of the overall cup height to the diameter of the base of the cup is 81 divided by 38, or 2.13, and the ratio of the cup height to the height of the convex curved portion 2 plus 5 is 81 divided by 40, or 2.025.

It will be appreciated that dimensional variations may be made in specific instances, from the dimensions set forth above, so long as they remain within the critical parameters set forth herein.

The side wall 2 and a part spherical surface which extends through an arc 42°, the radius of curvature (about a point lying on the center line of the drinking cup) being about 39 mm.

Figure 5:
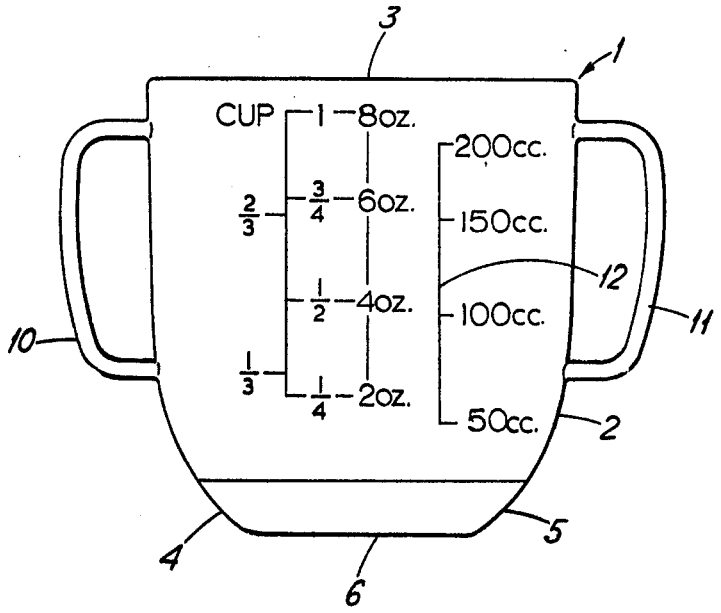
FIG. 5 is a further side elevation of the drinking cup shown in FIG. 1.

In this particular embodiment the liquid capacity of the drinking cup is at least eight fluid ounces and graduation marks 12 may be embossed on the exterior of the drinking cup at intervals to indicate the volume of the drinking cup up to such graduation marks for example, as fractions of the total capacity of the drinking cup, in ounces, and in cubic centimeters (see FIG. 5).

It should be stressed that a major advantage of the drinking cup constructed as described above is that the weight of the ballast may be as little as 0.4 ounces to provide adequate stability for the drinking cup whilst the total weight of the drinking cup may be between only 1.4 and 1.9 ounces, which is very much less than the weight of previously known self-righting drinking cups which only have about a 7 oz. volume and therefore cannot in any event be also used as a full 8 oz. capaity drinking cup. In fact, this example of a self-righting drinking cup weighs about the same as a conventional drinking cup.

A further important advantage provided by a drinking cup when constructed as described above is that the drinking cup will be self-righting without at least any substantial subsequent wobble even when tilted to its maximum inclined position where the side wall 2 of the drinking cup is in contact with a horizontal surface, whereas the previously known self-righting drinking cups would only right themselves from this same inclined position after wobbling back and forth many times, which would result in any liquid in such drinking cups being spilt out.

It should also be pointed out that the dimensions of the drinking cup are not of course restricted to those described above and shown in the drawing. An important factor, however, is the ratio of the total height of the drinking cup to the maximum height of the curved portion of the side wall. For example, a ratio of three to one would still provide the above mentioned advantage if a slightly heavier ballast were used.

The following is claimed:

1. A two-piece self-righting drinking cup comprising a generally rigid cylindrical hollow cup container having a downwardly inwardly curved side wall of uniform thickness and a bottom wall which is for the reception and retention of a liquid, a separate base member which is circular in cross section and on which the hollow cup container is mounted, means for mounting said cup container on said base member, said base member being rigid and having a convex outer surface progressively decreasing in diameter from the junction of said base member and said hollow cup member to the lowermost portion of said base member, said lowermost portion defining a flat bottom the diameter of which is at least 39% of the greatest external diameter of the hollow cup container, said base member having a structure including an enclosed compartment containing ballast, said ballast having a center of gravity which lies on a vertical axis extending through the center of said cup container, wherein said self-righting drinking cup is characterized by the following critical parameters:

(a) the ratio of the diameter of the lowermost portion of the base to the greatest diameter of the drinking cup itself is about 0.39 to 0.75, (b) the ratio of cup height to maximum cup diameter is about 0.80 – 1.1, (c) the ratio of the cup height to the diameter of the lowermost portion of the base is about 1.3 to 2.5, and (d) the ratio of cup height to the height of the convex portion of the base member is about 1.8 to 3.2.

wherein said self-righting drink cup resists being knocked over but quickly self right itself without any substantial subsequent wobble after being knocked over.

2. The drinking cup defined in claim 1, wherein the ratio of the cup height to the maximum cup diameter is about 1.

3. The drinking cup defined in claim 1, wherein the ratio of the cup height to the diameter of the lowermost portion of the base is about 1.3 to 2.5.

4. The drinking cup defined in claim 16, wherein said ratio of cup height to diameter of the lowermost portion of the base is about 2.13.

5. The drinking cup defined in claim 1, wherein the ratio of cup height to height of convex portion of the base member is about 2.

* * * * *